United States Patent [19]

Hawelka et al.

[11] Patent Number: 4,645,009

[45] Date of Patent: Feb. 24, 1987

[54] METHOD AND MEANS FOR PRODUCING AND DISPENSING EXTINGUISHING FLUIDS

[75] Inventors: Walter Hawelka; Walter Irsigler, both of Linz/Donau, Austria

[73] Assignee: Konrad Rosenbauer KG, Leonding, Austria

[21] Appl. No.: 733,512

[22] Filed: May 13, 1985

[30] Foreign Application Priority Data

May 18, 1984 [AT] Austria ..... 1643/84

[51] Int. Cl.[4] ..... A62C 35/00; A62C 5/02; B05B 7/00; E03B 00/00

[52] U.S. Cl. ..... 169/15; 239/61; 239/62; 239/310; 137/893; 137/895

[58] Field of Search ..... 169/14, 15, 43; 239/61, 239/62, 310; 137/892, 893, 895, 98, 114

[56] References Cited

U.S. PATENT DOCUMENTS 3,383,044 5/1968 Norstrud et al. ..... 239/61 X
4,224,956 9/1980 Klein ..... 169/14 X
4,503,915 3/1985 Gagliardo et al. ..... 239/310 X

FOREIGN PATENT DOCUMENTS 840295 7/1960 United Kingdom ..... 169/14

*Primary Examiner*—Andres Kashnikow
*Assistant Examiner*—Patrick N. Burkhart
*Attorney, Agent, or Firm*—Kurt Kelman

[57] ABSTRACT

The invention relates to a method and a device for producing and dispensing extinguishing fluids mixed with adjuvants. The adjuvants are drawn in by suction in a metered manner and fed to a suction or intake pipe of an extinguishing fluid pump. A partial volume of the extinguishing fluid proportional to the quantity of extinguishing fluid conveyed in the delivery pipe is withdrawn from the delivery pipe. A negative pressure is generated thereby, by means of which the adjuvant is drawn in by suction and mixed with the extinguishing fluid. The extinguishing fluid mixed with additive is then fed to the suction or intake pipe of the extinguishing fluid pump.

10 Claims, 5 Drawing Figures

Fig. 1
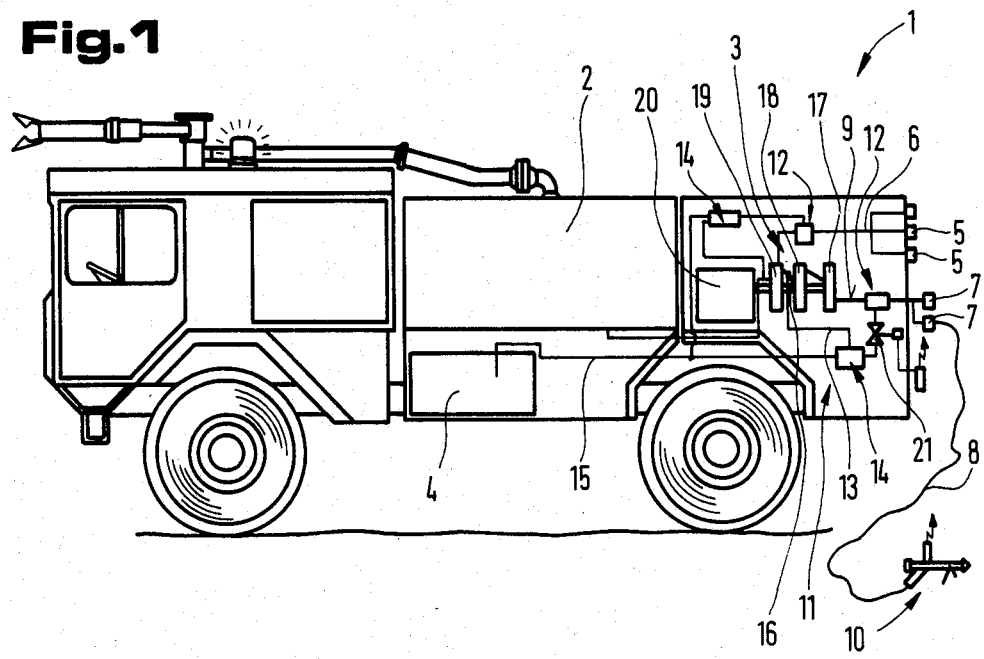
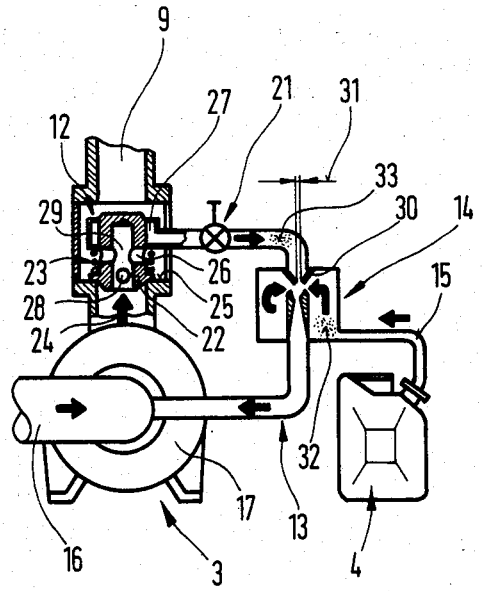
Fig. 2
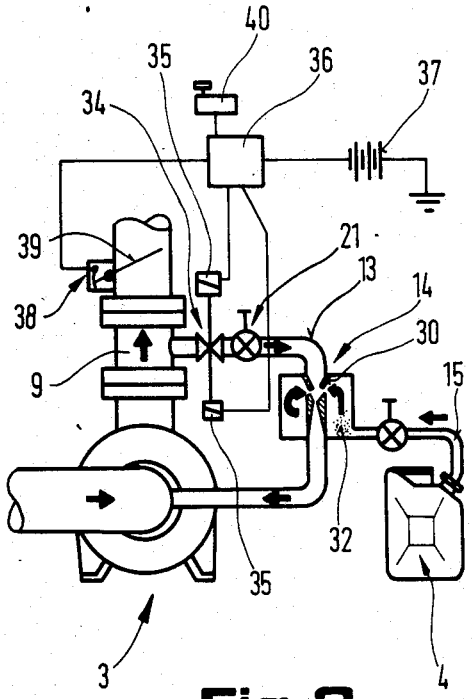
Fig. 3

METHOD AND MEANS FOR PRODUCING AND DISPENSING EXTINGUISHING FLUIDS

BACKGROUND OF THE INVENTION

1. Field of the Invention

The invention relates to apparatus for producing and dispensing extinguishing fluids mixed with adjuvants, in which the adjuvants such as foaming agents in particular, are drawn in by suction in a metered manner and are fed to a suction pipe of an extinguishing fluid pump.

2. Description of the Prior Art

Methods and devices are already known for the automatic production of extinguishing fluids mixed with additives, e.g. foams, bonding agents, "Halon' or tear gas. For example it is known for the production of extinguishing fluids in expanded form, to install a by-pass pipe between a delivery pipe and an intake pipe of the extinguishing fluid pump. An admixing device for the foaming agents, advantageously being an injector admixing device, in which the negative pressure is generated by the extinguishing fluid flowing through the same, is situated in this by-pass pipe. The negative pressure generated whilst the extinguishing fluid flows through the admixing device is utilised to draw foaming agent from a foaming agent tank. The quantity of the foaming agent added in the admixing device is determined in the course of tests by means of a manually adjustable foaming agent restrictor element. Once the required consistency of the extinguishing fluid in foam form is reached, the adjustment is retained. It is disadvantageous in this solution that foaming agent is also drawn from the foaming agent tank even if no extinguishing fluid is delivered at the outlets of the delivery pipe.

In view of the pressure differential between the delivery and intake pipes, the extinguishing fluid actually flows through the by-pass pipe irrespective of whether extinguishing fluid is needed or not, so that foaming agent is constantly added to the extinguishing fluid contained in the by-pass pipe or in the extinguishing fluid pump. This frequently has the result of causing an accumulation of foaming agent in the delivery pipe, which is propagated in the direction of the foaming agent tank, so that the extremely undesirable mixing of the water commonly carried along in extinguishing fluid tanks with foaming agent must be prevented by installing a check valve in the intake pipe of the extinguishing fluid pump. This check valve is commonly formed by a flow flap which, in the case of back pressure of the foaming agent, blocks the displacement of the extinguishing fluid against the delivery direction, i.e. in the direction of the extinguishing fluid tank. Upon utilising extinguishing systems of this nature on mobile service vehicles such as fire fighting vehicles, this establishes the disadvantage that after an interruption of the extinguishing operation and a subsequent additional utilisation of the extinguishing fluid during a particular period, extinguishing fluid is present in expanded form in the delivery portion of the delivery pipes which lacks the desirable mixture of water and foaming agent.

Furthermore, it is also already known that foaming agent may be fed direct into the delivery pipe via a foaming pump separate from the extinguishing fluid pump, in particular after the high-pressure stage of the extinguishing fluid pump. The incorporation of a foaming pump in the high-pressure section however requires a comparatively great technological and financial investment.

OBJECTS AND SUMMARY OF THE INVENTION

It is an object of this invention to provide a apparatus for the production of extinguishing fluids mixed with adjuvants or additives, which allow uncomplicated metering of the quantity of additive to be added to the extinguishing fluid as well as economical consumption of the same.

According to the present invention, apparatus for producing and dispensing extinguishing fluids mixed with adjuvants comprises an extinguishing fluid pump having a suction intake pipe and a pressure delivery pipe, a bypass pipe extending between the suction intake and pressure delivery pipes and incorporating a premixer device connected to an adjuvant tank via an adjuvant suction intake pipe, the bypass pipe being connected to the pressure delivery device through a control valve preceding the premixer device and operable in response to the flow of fluid through the pressure delivery pipe to draw from the pressure delivery pipe a partial volume of the extinguishing fluid proportionate to the volume flowing therethrough.

It is an advantage of the uncomplicated solution of the invention that the volume of adjuvant added to the extinguishing fluid is a direct function of the quantity of extinguishing fluid withdrawn at the outlet of the delivery pipe of the extinguishing fluid pump. The admixture of adjuvant is thereby interrupted in case of interruption of the outflow of extinguishing fluid at the outlet of the delivery pipe, and a constant proportion of adjuvant is added to the extinguishing fluid, irrespective of the momentary outflow volume at the outlet of the delivery pipe of the extinguishing fluid pump.

A back pressure, of mixing of the extinguishing fluid present in the extinguishing fluid tank with adjuvant, is reliably prevented. The invention makes it possible to add adjuvant only in the region of the high-pressure section of an extinguishing fluid pump, so that it is possible to operate with unmixed extinguishing fluid at the pressure outlet of the low-pressure section.

Provision is made according to an embodiment of the invention, for the extinguishing fluid pump to be of the multistage type, and for the partial volume of the extinguishing fluid to be withdrawn after the last stage of the extinguishing fluid pump and for the partial volume of the extinguishing fluid mixed with the adjuvant formed by foaming agent to be fed to the extinguishing fluid pump between two stages and in particular before the first high-pressure stage. Different extinguishing fluids may thereby be produced under different pressure in a simple manner. For example, it is possible to draw quenching water after the low-pressure section of the pump in the case of fire service vehicles, whereas either quenching water or quenching water mixed with additive, for example foaming agent, may be drawn after the high-pressure section of the pump, and this allows for greater versatility in fire fighting.

Suitably the partial volume of the extinguishing fluid draws in the adjuvant by injector effect and conveys the adjuvant into the inlet pipe of the extinguishing fluid pump or between stages of the pump. A separate metering operation on the adjuvant quantity fed to the injector is not required since the partial volume of the extinguishing fluid fed to the injector is already proportional to the extinguishing fluid quantity extracted at the outlet of the delivery pipe.

The incorporation of the control valve assures the admixture of the adjuvant in adequate proportion to the extinguishing fluid, as well as preventing a back-up of the extinguishing fluid mixed with adjuvant into the extinguishing fluid tank, since in the case of a reduced delivery volume or delivery flow in the extinguishing fluid, delivery pipe of the partial volume is reduced commensurately by the control valve until no adjuvant is drawn in by suction. The supply of adjuvant to the by-pass pipe is reliably prevented in the absence of the main flow, notwithstanding the clearance losses and leakage losses repeatedly occurring in systems of this nature. It is thus assured that the residual delivery volumes resulting from clearance and leakage losses cannot trigger the admixture of adjuvant.

Suitably the control valve comprises a valve member displaceable in a valve casing in the direction of flow through the pressure delivery pipe and loaded against the flow direction to a closed position by biasing means, the valve member having flow control apertures moveable from a closed position upstream of the by-pass pipe in the direction of flow through the pressure delivery pipe into communication with the by-pass pipe whereby the through flow cross section between the delivery and by-pass pipes is increased upon displacing the valve member in the direction of flow.

In a preferred embodiment the control valve comprises a valve member connected to a control piston having an internal bore extending from an open end longitudinally in the direction of flow through the pressure delivery pipe, the piston being displaceably located in a bore of the valve casing, the internal bore of the piston having lateral control apertures spaced longitudinally thereof, spacings between the control apertures and a control position closing the inner bore with respect to a valve passage extending from the bore of the valve casing to the by-pass pipe corresponding to a path of displacement of the control piston according to different delivery volumes in the pressure delivery pipe. More extinguishing fluid may penetrate into the by-pass pipe through control apertures, thanks to the longitudinal displacement of the control piston and the cross-sectional area increased thereby. An adaptation of the magnitude of the partial volume is obtained at the oulet of the delivery pipe, which is matched to the different delivery volumes, in an uncomplicated manner.

Suitably first and second spaced apart rows of control apertures are incorporated as bores of different aperture size spaced in the longitudinal direction of the piston, and a first spring deflection of a compression spring forming the biasing device corresponds to a first delivery volume in the delivery pipe, and a distance between the control position and the first row of control apertures is smaller than the first spring deflection, and a second spring deflection corresponds to a larger delivery volume, a distance between the spaced rows of control apertures being smaller than the difference between the first and second spring deflections. This embodiment is advantageous in fire service vehicles, in which each "consumer" may draw a preset volume of extinguishing fluid. Thanks to stepped increase of the partial volume or propellant water volume drawn from the delivery pipe, the said volume may be adapted rapidly and precisely to the adjunctive connection of several consumers having a predeterminable consumption.

The control apertures spaced apart from each other in the longitudinal direction of the inner bore of the piston suitably have different aperture sizes, and the valve passage has a length corresponding in that direction to the longitudinal spacing between the control apertures in the direction of displacement. A linear or progressive increase of the partial volume of propellant water volume may be obtained in simple manner as a function of the number of control apertures connecting the inner bore to the by-pass pipe.

Suitably the premixer is formed by an injector connected to the suction or intake pipe for the additive whereby a corresponding quantity of adjuvant is drawn in by suction by means of the partial volume of the extinguishing fluid without other control action and without any ancillary power.

In accordance with the invention, the delivery pipe and the by-pass pipe may have arranged between them a volume control valve, comprising a servo-operated valve arranged to close the by-pass in an inoperative position and a driving system for opening and closing the valve being coupled to a flow meter transmitter arrnaged within the delivery pipe for determining the flow and generating a signal operating the valve proportionally to the delivery volume. The ratio between the delivery volume and partial volume of the extinguishing fluid may thereby be adapted rapidly and simply to different conditions. Furthermore, the incorporation of a flow valve in the delivery pipe is unnecessary, so that the flow velocity or the flow characteristic is not altered.

Advantageously the servo-operated valve and the flow meter transmitter are coupled to a control device for setting the ratio between the delivery volume and the volume of adjuvant, whereby the ratio between the delivery volume in the delivery pipe and the partial volume drawn therefrom may be adapted to different conditions or adjuvant requirements in a simple manner.

Suitably a shut-off device is arranged to precede the premixer device in the by-pass pipe, and a remotely controllable drive to the shut-off device is coupled to the control device. The shut-off device may be incorporated in the servo-operated valve.

The drive of the shut-off device is suitably operatively coupled to a control element situated at a discharge point for extinguishing fluid, for example an extinguishing fluid gun, suitably by wireless means, so that the device may be placed into and out of operation direct from the point of utilisation of the extinguishing fluid.

BRIEF DESCRIPTION OF THE DRAWINGS

The invention will now be described, by way of example, with reference to the accompanying partly diagrammatic drawings, in which:

FIG. 1 is a schematic elevation of apparatus according to the invention for producing foamy extinguishing fluid in a fire service vehicle, FIG. 2 is a diagrammatical diagram of apparatus for producing foamy extinguishing fluid, including a control valve situated in the delivery pipe, FIG. 3 is a diagram of a modified embodiment of apparatus for producing foamy extinguishing fluids utilising a servo-operated valve.

DETAILED DESCRIPTION OF THE PREFERRED EMBODIMENT

Figure 4:
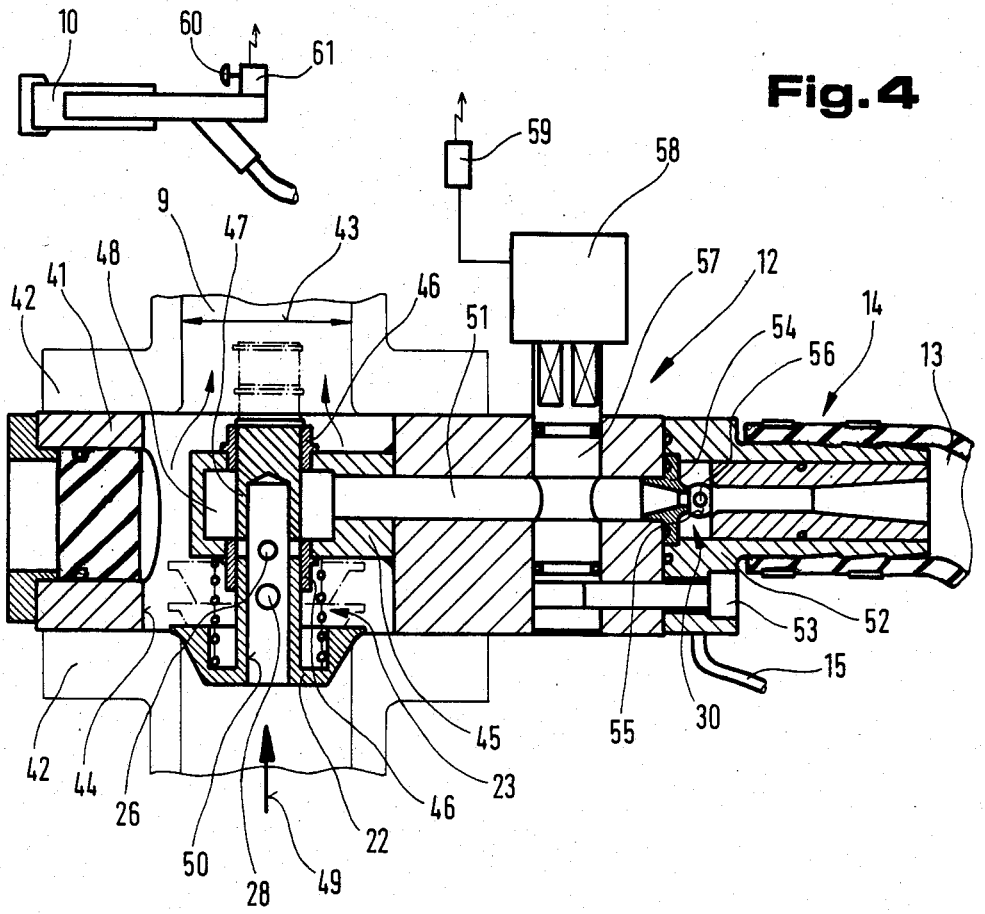
FIG. 4 is a sectional elevation of a control valve for use in apparatus according to the invention and installed in a delivery pipe, for producing partial volumes of the extinguishing fluid.

The service vehicle of FIG. 1 is a fire service vehicle 1 which comprises an extinguishing fluid tank 2, an extinguishing fluid pump 3, a foaming agent tank 4 and couplings 5 for connection of hoses, not shown, to a low-pressure delivery pipe 6 and couplings 7 for connection of high pressure hoses 8 to a high-pressure delivery pipe 9. An extinguishing fluid delivery device comprising a gun 10 is connected to the hose 8 for spraying the extinguishing fluid supplied by the hose 8. Between the extinguishing fluid pump 3 and couplings 7 providing pressure outlets is situated apparatus 11, for producing extinguishing fluids mixed with additives according to the invention. The apparatus 11 comprises a control valve 12 mounted in the delivery pipe 9 which precedes a by-pass pipe 13 in the flow direction. A premixer 14 is arranged in the by-pass pipe and is connected by an intake or suction pipe 15 to the foaming agent tank 4 for supplying the additive formed by a suitable foaming agent. The by-pass pipe 13 leads into an intake pipe 16 of a high-pressure stage 17 of a high-pressure section of the extinguishing fluid pump 3. The high-pressure stage 17 and another high-pressure stage 18 of the high-pressure section are preceded by a low-pressure stage 19 of a low-pressure section of the extinguishing fluid pump. The pressure stages of the extinguishing fluid pump 3 are driven by a driving engine 20 which may at the same time be the vehicle drive engine. A shut-off device 21 may be installed in the by-pass pipe 13 between the control valve 12 and the premixer 14.

The arrangement of the by-pass pipe 13 is illustrated on an enlarged scale in FIG. 2 in which it is apparent that the control valve 12 is situated in the throughflow cross-section of the delivery pipe 9. The valve 12 has a moveable valve member 22 which is thrust against a valve seat 25 situated within the delivery pipe by means of a biasing mechanism 23 against the direction of flow denoted by arrow 24. When extinguishing fluid is withdrawn by means of the extinguishing fluid gun 10, FIG. 1, the valve member 22 is lifted off the valve seat 25 by the fluid flow engendered thereby, so that control apertures 26 lead into a valve passage 27 which is connected to an inlet of the by-pass pipe 13. A partial volume of the extinguishing fluid coming from the high-pressure stage 18, which is determined by the cross section of the control apertures 26 may consequently flow into the by-pass pipe. Since an initially known quantity of extinguishing fluid is withdrawn upon making use of the extinguishing fluid gun 10, the cross-sectional areas of the control apertures 26 may be so dimensioned that a partial volume corresponding to the volume of extinguishing fluid withdrawn, for example 200 liters/minute, is fed to the by-pass pipe 13. If, as apparent from the illustration in FIG. 1, two connectors 7 are provided on the fire service vehicle, i.e. two parallel withdrawal points for extinguishing fluid, it is possible for additional control apertures 28 to be incorporated in control valve 12, these control apertures being staggered in the longitudinal direction of the inner valve bore opposite to the direction of flow—arrow 24. If a hose 8 bearing an extinguishing fluid gun 10 is then also connected to the second connector and placed in operation, the flow of the extinguishing fluid in the delivery pipe 9 is increased and the valve member 22 is raised farther. This places the additional control apertures 28 also within range of the valve passage 27 and extinguishing fluid may enter into the by-pass pipe 13 through the control apertures 26 as well as the control apertures 28. The delivery of the extinguishing fluid to the control apertures 26,28 occurs through an inner bore 29 in the valve member 22. The partial volume of the extinguishing fluid derived by means of the control valve, which may be propellant water, is fed to the premixer 14 if the shut-off device 21 is open. The premixer 14 comprises an injector 30 having a constricted pipe cross-section 31, and an intake pipe 15 which leads from the foaming agent tank 4. Whilst a partial volume extinguishing fluid or of the propellant water flows through the premixer 14, a negative pressure proportional to the propellant water volume is generated in the injector 30. This negative pressure has the result that a volume of foaming agent 32 proportional to the negative pressure is drawn in by suction and mixed with the partial volume of the extinguishing fluid supplied through the by-pass pipe 13, which may consist of water or water already mixed with foaming agent 32. This mixture of foaming agent and extinguishing fluid is drawn from the premixer 14 through the by-pass pipe 13 by negative pressure prevailing in the intake pipe 16 of the high-pressure section of the extinguishing fluid pump 3.

As a result only a portion of foaming agent proportional to the propellant water volume and thus to the delivery volume is drawn from the foaming agent tank 4 by the propellant water volume, the propellant water volume being proportional to the volume extracted at the outlet of the delivery pipe 9. It is thus unnecessary to control or meter the foaming agent 32 in the intake pipe 15. In like manner other additives may be mixed with extinguishing fluids with possibly slightly modified embodiments.

A modified embodiment of the apparatus according to the invention is illustrated in FIG. 3.

In this embodiment, the by-pass pipe 13 is connected through a volume control valve 34 to the high-pressure delivery pipe 9 of the extinguishing fluid pump 3. The volume control valve 34 may be adapted also to close the by-pass pipe 13, in which case the shut-off device 21 may be omitted.

Drives 35 of the volume control valve 34, which is a servo-operated valve, are coupled to a control device 36 supplied with power from a voltage source 37. A flow valve signal sender 38, e.g. an electromechanical transducer such as a rotary potentiometer or rotary field emitter connected to a flow flap 39 situated within the delivery pipe 9, is coupled to the control device 36. The flow flap 39 is arranged to be displaced commensurately to the flow prevailing in the delivery pipe 9, and to transmit corresponding signals to the control device 36 by the sender 38. The drives 35 of the volume control valve 34 are arranged to be displaced proportionally to a voltage developed by the control device 36 in response to the sender signals, which is higher under powerful flow and lower under diminished flow. The ratio in which the displacement of the drives 35 and thereby of the throughflow volume through the volume control valve 34 will occur in proportion to the delivery volume in the delivery pipe 9 may be set to give the required mixture ratio between extinguishing fluid 33 and foaming agent 32 by means of a setting element 40. The magnitude of the partial volume of the extinguishing fluid fed to the by-pass pipe extension 13 through the volume control valve 34 is decisive, as already described with reference to FIG. 2, for the negative pressure generated in the premixer 14 whilst the partial volume flows through the injector 30, and thus for determining the volume of foaming agent 32 drawn from the foaming agent tank 4 via the intake pipe 15. As already described with reference to the embodiment of FIG. 2, the foaming agent mixed with the partial volume of the extinguishing fluid is fed to the intake pipe 16 of the extinguishing fluid pump 3. The further arrangement and operation of the premixer correspond to that according to FIG. 2.

The control valve 12 of FIGS. 1 and 2 is illustrated on an enlarged scale in FIG. 4 and comprises a plate-like valve casing 41 which is installed between two flanges 42 of the delivery pipe 9. The valve casing 41 has an aperture 44 whose cross section is determined by a cross-sectional area of the delivery pipe determined by the pipe diameter 43. The control piston 47 is preferably integrally connected to the valve member 22 and is located in guiding sleeves 46 supported by a projecting support element 45 of the valve casing 41. A valve passage 48 traversed by the control piston 47 is situated in the support element 45. The valve member 22 and the control piston 47 are formed with an inner bore 50 extending upwardly in the flow direction 49. The control piston 47 comprises an annular jacket transpierced radially by control apertures 26 and 28, which may be bores, slots or the like. The valve passage 48 is connected to an inlet of a premixer 14 fastened direct on the valve casing 41 and a bore 51 extending at right angles to the direction of flow 49 in the valve casing connects valve passage 48 to an inlet of the premixer. The premixer 14 comprises a housing 52 which is secured to the valve casing 41 by means of screws 53. In this housing 52 is installed a nozzle plate 54, followed by a mixing chamber 55 of the injector 30. The intake or suction pipe 15 leads from the foaming agent tank 4 into the injector 30 via an orifice 56. At the outlet of the premixer 14, the mixture formed from foaming agent and extinguishing fluid flows into the by-pass pipe 13, and as described above in relation to FIGS. 2 and 3, it is then supplied to the intake pipe 16 of the extinguishing fluid pump 3 through the by-pass pipe 13.

When designing the premixer 14, it should be considered that upon mixing foaming agent with extinguishing fluid, the proportion of the foaming agent may correspond for example to between 1% and 10% of the extinguishing fluid volume delivered. The partial volume of the extinguishing fluid flowing in the by-pass pipe 13 derived from the flow of extinguishing fluid in the delivery pipe 9 should be proportioned accordingly. If, for example, 5% of foaming agent is to be added to the extinguishing fluid volume delivered, the foaming agent quantity drawn from the delivery pipe corresponds to approximately 8.3% of the quantity of extinguishing fluid conveyed. According to experience, 0.6 parts of foaming agent are drawn in by 1 part of propellant water under appropriate design of the premixer, and this ratio corresponds to an approximate pressure differential of 4 bars between the inflow and outflow pressures of the injector 30. It is assured thereby that whilst say 8.3% of propellant water flows through the premixer, 5% of foaming agent is drawn in and fed to the intake pipe of the extinguishing fluid pump. The preceding numeric example however represents no more than one of the numerous design versions, since the magnitude of the partial volume or of the propellant water volume is determined amongst other things by the pressure differential between the inlet and outlet of the injector and by the proportion of the foaming agent or of the additive to be added to the extinguishing fluid. In this connection, it has also to be considered that an excessive back pressure at the outlet of the injector may cause a collapse of the flow and thus a failure of the foaming agent or additive intake by suction and the magnitude of the partial volume or propellant water volume should consequently be adapted in accordance with available pressure conditions.

Within the bore 51 in the valve casing 41 is also incorporated a shut-off device 57 whereby the feed of extinguishing fluid to the premixer 14 may be prevented. As shown diagrammatically, the shut-off device may be coupled with a remotely controllable drive 58. The latter may be actuated by a receiver 59 by means of a pushbutton 60 of a transmitter 61 which may preferably be operated by an operative carrying the extinguishing fluid gun 10, and may also be installed directly on the gun 10. Additives particularly foaming agents may thereby be added direct at the point of application of the extinguishing fluid without another operative and in immediate adaptation to the prevailing operating conditions.

Figure 5:
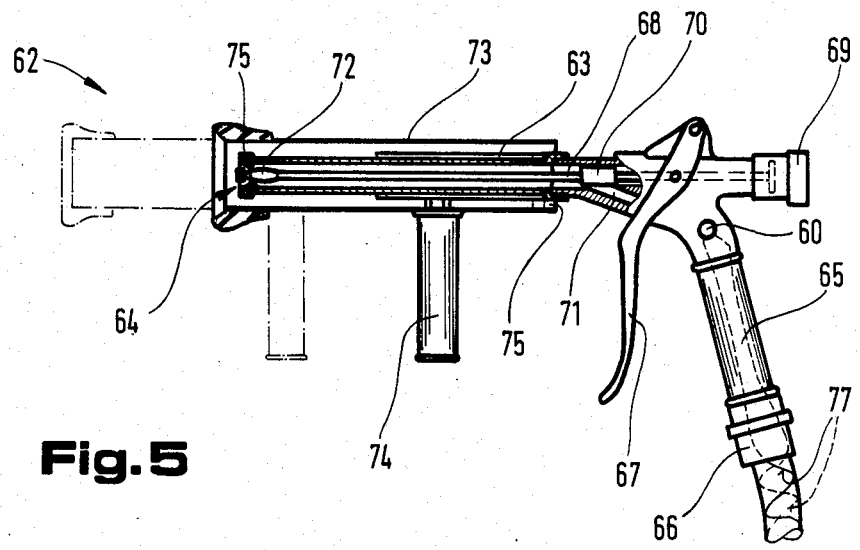
FIG. 5 is a partly sectional elevation of an extinguishing fluid gun comprising an integrated foam tube for use in conjunction with a device according to the invention.

In FIG. 5 is shown an extinguishing fluid gun 62 which may preferentially be utilised for spraying extinguishing fluids mixed with additives and produced with apparatus 11. This extinguishing fluid gun 62 has a gun tube 63 comprising an ejector aperture 64 at one end and spaced therefrom a handle 65. The handle has a hose connector 66 of conventional design in its end facing away from the gun tube 63 and a trigger 67. A valve linkage 68 operatively coupled to the trigger 67 is situated within the gun tube 63. A shock absorber 69 which is also operatively coupled to the valve linkage 68 is situated in an area of the gun tube 63 opposite the ejector aperture 64. The valve linkage 68 has a piston 70 for closing the connecting pipe 71 coming from the hose connector 66, and a spray nozzle 72. The extinguishing fluid gun 62 is equipped with a foam tube 73 which is moveably mounted telescopically over the gun tube 63, and a handle 74 is secured on the foam tube 73. The foam tube 73 is normally held in the carrying position shown by solid lines with respect to the gun tube 63 by means of a bayonet coupling 75 operated manually. If the extinguishing fluid gun 62 is to be utilised to apply extinguishing fluids provided with additives and foaming agents in particular, the foam tube 73 is displaced from the position shown by solid lines into the position shown by dash-dotted lines. To this end, the foam tube 73 is turned by means of the handle 74 around the longitudinal axis of the gun tube 63, so that the mating bayonet joint bars of the bayonet coupling 75 are disengaged, the foam tube 73 then is pushed forwardly to the dash-dotted line and locked in this position by being turned back with the same bayonet coupling elements with respect to the gun tube 63.

The connecting pipe 71 may then be opened by pulling the trigger 67 in the direction of the handle 65, so that extinguishing fluid reaches the ejector opening 64 via the gun tube 63. If the trigger is pulled more powerfully, the spray nozzle or cone 72 is moved into the ejector opening and the extinguishing fluid emerging therefrom is atomised. It is thus possible in uncomplicated manner to generate a solid jet or mist of extinguishing fluid with the extinguishing fluid gun 62.

To avert a whipping action or a risk to the user or the operatives utilising the extinguishing fluid gun 62, the closing displacement of the closing piston 70 is suitable caused by a compression spring acting in the direction of the ejector aperture 64, and is damped by means of the shock absorber 69, so that a smooth closure of the connecting pipe 71 is obtained.

To turn on the apparatus 11, without the personnel or operatives using the extinguishing fluid gun 62 leaving the point of application and without another operative having to be placed at the control apparatus generally at the service vehicle itself, a pushbutton 60 is installed in the handle 65. This pushbutton 60 may for example be connected to the control device 36 of FIG. 3, or to the drive 58 in FIG. 4, by conductors 77 situated in the handle 65 and in the hosepipe 76 connected at the hose connector 66. Apparatus 11 may thereby be activated for addition of additive to the extinguishing fluid. Alternatively as shown in Figure 4 it is possible to perform a wireless transmission of the activation order, the sender 61 shown in FIG. 4 then being preferably withdrawably installed in the handle 65 of the extinguishing fluid gun, such that upon stowing the extinguishing gun 62 in the service vehicle in holding means, the holding means are so formed that an accumulator present in the transmitter 61 is connected to the current supply of the service vehicle for recharging. The pushbutton 60 may also be utilised by a fireman to issue a call for help for example, if he gets into a situation of special danger and requires assistance.

The apparatus according to the invention may also be applied for admixing additives, in particular tear gas, foaming agent, bonding agents for oils, "Halon" or the like, not only in association with the high-presure section of an extinguishing fluid pump, but also in association with the low-pressure section. The application of the invention is unaffected by the number of stages present in the low-pressure or high-pressure sections of a fire extinguishing pump and there is no necessity for the exinguishing fluid pump to have both a low-pressure section and a high-pressure section, the apparatus according to the invention being equally useful in the case of extinguishing fluid pumps which comprise solely a high-pressure section. The apparatus of the invention may be utilised in combination with extinguishing fluid pumps, irrespective of whether the systems in question are stationary installations or mobile systems on vehicles or portable systems.

The distribution of the extinguishing fluid mixtures produced by means of the apparatus according to the invention may be performed via hoses, pipes, extinguishing fluid guns, foam tubes, launchers or spray nozzles and the like, irrespective of whether these are organised in a mobile or a stationary manner. What is essential according to the invention is that the additive is added to the extinguishing fluid by means of a so-called suction admixing operation and that there is no need for any mechanical system for forcing foaming agent into a delivery pipe under pressures of different magnitude.

The term "suction pipe" or intake pipe has been used throughout the description for the pipe preceding the inlet of the low-pressure section or high-pressure section of the pump, although an overpressure is already present for example in a pipe leading to the inlet of a high-pressure section of an extinguishing fluid pump, which may also be the case in a pipe leading to the inlet of a low-pressure section of an extinguishing fluid pump, if the pump supply is taken for example from a water supply grid operated under overpressure. In principle, the term "suction pipe" or intake pipe should thus be understood as being the pipe through which extinguishing fluid is fed to the inlet of an extinguishing fluid pump or of a part of this extinguishing fluid pump for increasing pressure. The operation of the apparatus according to the invention is also assured if an overpressure already prevails in these "suction pipes", since the partial volume of the extinguishing fluid or the propellant water is withdrawn at a point having a higher pressure and the extinguishing fluid quantity mixed with the additive is forced into the "suction pipe" under a higher pressure than that prevaiing in this pipe.

While the invention and many of its attendant advantages will be understood from the foregoing, it will be apparent that changes may be made in the method of operation and in the form construction and arrangement of parts described without departing from the spirit and scope of the invention set forth in the ensuing claims.

What is claimed is:

1. An apparatus for producing and dispensing an extinguishing fluid mixed with an adjuvant, comprising (a) a supply of the extinguishing fluid, (b) a supply of the adjuvant, (c) a fluid pump having (1) a suction intake pipe connected to the supply of the extinguishing fluid and (2) a pressure delivery pipe, (d) a by-pass pipe extending between the suction intake and pressure delivery pipes, the by-pass pipe having (1) an intake connected to the pressure delivery pipe and an output connected to the suction intake pipe, (e) a premixer device in the by-pass pipe, the premixer device having (1) a suction intake pipe connected to the adjuvant supply, and (f) a control valve in the pressure delivery pipe, the valve connecting the pressure delivery pipe to the by-pass pipe intake and comprising (1) a valve casing and (2) a valve member displaceable in the valve casing in response to the fluid pressure in a direction of flow of the fluid through the pressure delivery pipe from a closed to an open position, the valve member comprising a control piston defining fluid flow control aperture means communicating with the by-pass pipe intake in the open position for diverting a portion of the volume of the fluid flowing through the pressure delivery pipe to the by-pass pipe intake, the diverted volume portion being proportionate to the fluid volume passing through the pressure delivery pipe.

2. The apparatus of claim 1, further comprising biasing means having a force biasing the valve member into the closed position in a direction opposite to the flow direction when the biasing force exceeds the fluid pressure and progressively permitting the displacement of the valve member proportionate to the fluid pressure for proportionally increasing the diverted fluid volume portion.

3. The apparatus of claim 2, wherein the valve casing has a bore extending in the fluid flow direction and a passage connecting the valve casing bore to the by-pass pipe intake, the control piston is displaceable in the valve casing bore, the control piston defining an axial bore extending in the fluid flow direction from an open end in the valve member and the control aperture means consisting of laterally extending control apertures in the control piston in communication with the axial control piston bore, the control apertures being axially spaced for respectively closing communication between the inner control piston bore and the valve casing passage and progressively opening said communication in proportion to the path of displacement of the control piston under the fluid pressure.

4. The apparatus of claim 3, wherein the control apertures are arranged in two axially spaced rows, the size of the apertures in a first one of said rows differing from that of a second one of said rows, the biasing means being a compression spring having a first spring compression path corresponding to a first fluid volume in the pressure delivery pipe and a second spring compression path corresponding to a fluid volume in the pressure delivery pipe larger than the first fluid volume, and an axial distance of the first row of the control apertures from the valve casing passage is smaller than the first spring compression path while an axial distance between the first and second rows is smaller than the differences between the first and second spring compression paths.

5. The apparatus of claim 3, wherein the axially spaced control apertures have different sizes and the valve casing passage has a length corresponding to the sum of the axial distances between the control apertures.

6. A device as claimed in claim 1 in which the premixer comprises an injector device having a suction chamber connected to the suction intake pipe for adjuvant.

7. A device according to claim 1, in which a servo-operated volume control valve is installed between the fluid pipe and the by-pass pipe and arranged to close the by-pass pipe in an inoperative position, a driving system for opening and closing the valve being coupled to a flow meter transmitter arranged within the delivery pipe for determining the flow and generating a signal operating the valve proportionately to the delivery volume.

8. A device as claimed in claim 7 in which the servo-operated valve and the flow meter transmitter are coupled to a control device for setting the ratio between the fluid volume and the volume of adjuvant.

9. A device according to claim 8, in which a shut-off device is arranged to precede the premixer device in the by-pass pipe, and a remotely controllable drive for the shut-off device is coupled to the control device.

10. A device according to claim 9, in which the drive of the shut-off device is operatively coupled to a control element situated at a discharge point for extinguishing fluid.

* * * * *